US008357047B2

(12) United States Patent
Ryan et al.

(10) Patent No.: US 8,357,047 B2
(45) Date of Patent: Jan. 22, 2013

(54) RECOVERING A PERSISTENT STORAGE UNIT IN A WAGERING GAME SYSTEM

(75) Inventors: Chad A. Ryan, Henderson, NV (US); Jorge Luis Shimabukuro, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 930 days.

(21) Appl. No.: 12/446,303

(22) PCT Filed: Oct. 19, 2007

(86) PCT No.: PCT/US2007/022343

§ 371 (c)(1),
(2), (4) Date: Apr. 20, 2009

(87) PCT Pub. No.: WO2008/051476

PCT Pub. Date: May 2, 2008

(65) Prior Publication Data

US 2011/0003643 A1 Jan. 6, 2011

Related U.S. Application Data

(60) Provisional application No. 60/862,386, filed on Oct. 20, 2006, provisional application No. 60/893,030, filed on Mar. 5, 2007.

(51) Int. Cl.
*A63F 9/24* (2006.01)

(52) U.S. Cl. ..... 463/43

(58) Field of Classification Search ..... 463/43
See application file for complete search history.

(56) References Cited

U.S. PATENT DOCUMENTS

| | | | | |
|---|---|---|---|---|
| 4,727,544 | A * | 2/1988 | Brunner et al. | 463/29 |
| 4,948,138 | A * | 8/1990 | Pease et al. | 463/24 |
| 6,600,614 | B2 * | 7/2003 | Lenny et al. | 360/31 |
| 7,116,782 | B2 | 10/2006 | Jackson et al. | |
| 2003/0046470 | A1 * | 3/2003 | Sivertsen | 710/304 |
| 2005/0176493 | A1 * | 8/2005 | Nozaki et al. | 463/24 |
| 2006/0048008 | A1 * | 3/2006 | Haishima | 714/27 |
| 2006/0073890 | A1 * | 4/2006 | McAllister et al. | 463/29 |
| 2006/0205513 | A1 * | 9/2006 | Breckner et al. | 463/43 |

OTHER PUBLICATIONS

"International Search Report for Application No. PCT/US2007/22343, date mailed Apr. 7, 2008", 4 pgs.
"Written Opinion of the International Searching Authority for Application No. PCT/US2007/22343, date mailed Apr. 7, 2008", 7 pgs.

* cited by examiner

*Primary Examiner* — Matthew W Such
*Assistant Examiner* — Robert Carpenter
(74) *Attorney, Agent, or Firm* — Schwegman Lundberg & Woessner, P.A.

(57) ABSTRACT

Systems and methods include detecting the failure or imminent failure of a persistent storage unit for a wagering game machine. Upon detection of the failure, a flag is set to indicate that failed persistent storage unit is being replaced. After replacement, the wagering game machine is restarted. The flag indicating persistent storage unit replacement is read and wagering game machine software assets are automatically loaded onto the replacement persistent storage unit. The software assets to be loaded may be determined from an asset list maintained on the wagering game machine or on a server communicably coupled to the wagering game machine.

18 Claims, 6 Drawing Sheets

RECOVERING A PERSISTENT STORAGE UNIT IN A WAGERING GAME SYSTEM

RELATED APPLICATION

This patent application is a U.S. National Stage Filing under 35 U.S.C. 371 from International Patent Application Ser. No. PCT/US2007/022343, filed Oct. 19, 2007, and published on May 2, 2008, as WO 2008/051476 A2 and republished as WO 2008/051476 A3, which claims the priority benefit of U.S. Provisional Patent Application Ser. No. 60/862,386 filed Oct. 20, 2006 and entitled "RECOVERING A PERSISTENT STORAGE UNIT IN A WAGERING GAME SYSTEM" and to U.S. Provisional Patent Application Ser. No. 60/893,030 filed Mar. 5, 2007 and entitled "RECOVERING A PERSISTENT STORAGE UNIT IN A WAGERING GAME SYSTEM", the contents of which are incorporated herein by reference in their entirety.

FIELD

Embodiments of the inventive subject matter relate generally to wagering game systems, and more particularly, to recovering a persistent storage unit in a wagering game system.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007 WMS Gaming, Inc.

BACKGROUND

Wagering game machine makers continually provide new and entertaining games. One way of increasing entertainment value associated with casino-style wagering games (e.g., video slots, video poker, video blackjack, and the like) includes offering a variety of base games and bonus events. However, despite the variety of base games and bonus events, players often lose interest in repetitive wagering gaming content. In order to maintain player interest, wagering game machine makers frequently update wagering game content with new game themes, game settings, bonus events, game software, and other electronic data.

It is often desirable to store the software applications and content used by a wagering game machine on a persistent storage unit such as a hard drive. However, hard drives have a finite lifetime, and wagering game machines are typically running almost constantly. As a result, a hard drive failure is almost inevitable. Further, due to the number of wagering games that may be present on a casino floor, it is possible that a hard drive fails on some wagering game machine on the casino floor on an almost daily basis.

BRIEF DESCRIPTION OF THE FIGURES

Embodiments of the invention are illustrated by way of example and not limitation in the Figures of the accompanying drawings in which.

DESCRIPTION OF THE EMBODIMENTS

Example Operating Environment

Example Wagering Game Machine Architecture

Figure 1:
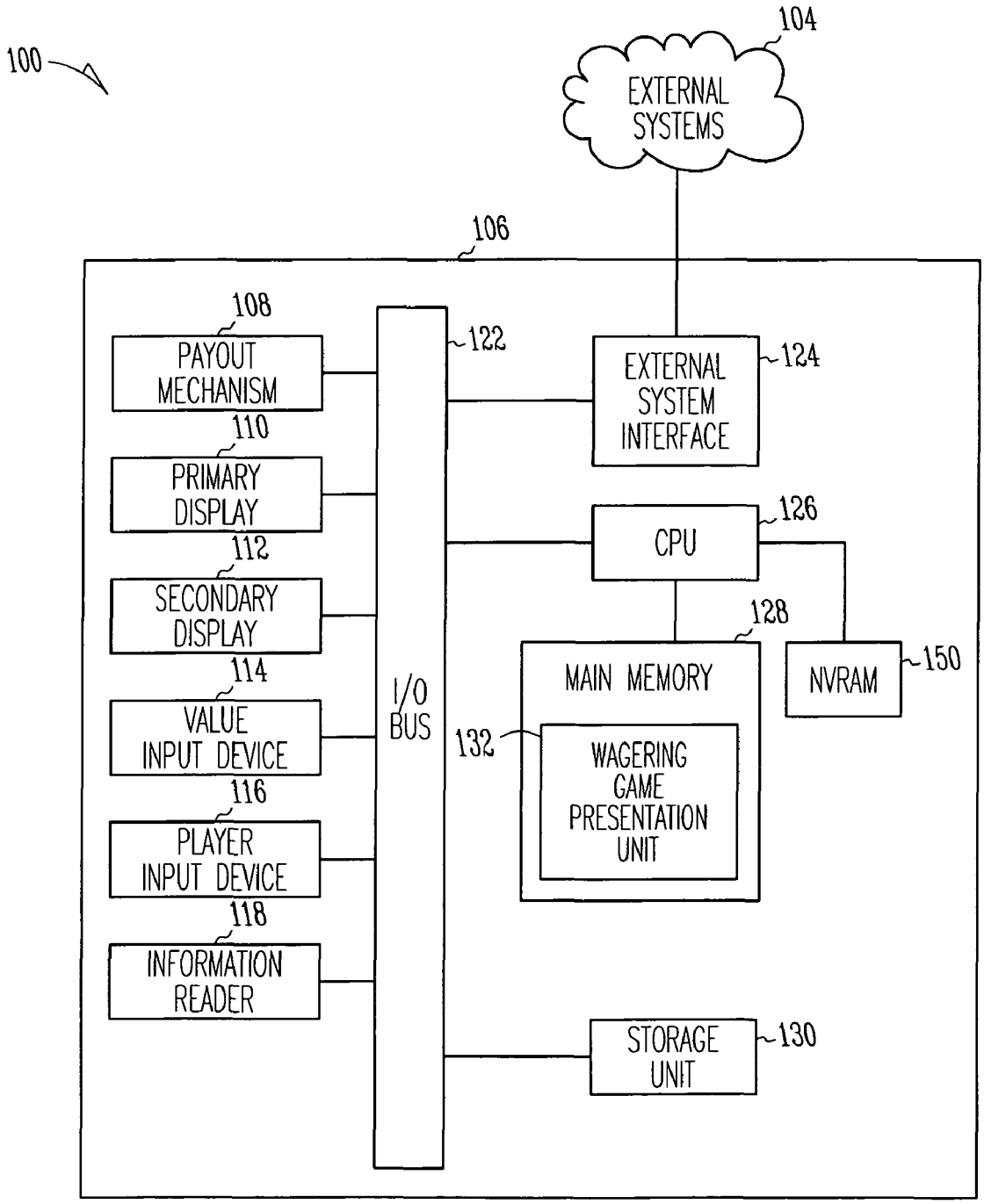
FIG. 1 is a block diagram illustrating a wagering game machine architecture, including a control system, according to example embodiments of the invention.

FIG. 1 is a block diagram illustrating a wagering game machine architecture, including a control system, according to example embodiments of the invention. As shown in FIG. 1, the wagering game machine 106 includes a central processing unit (CPU) 126 connected to main memory 128, which includes a wagering game presentation unit 132. In one embodiment, the wagering game presentation unit 132 can present wagering games, such as video poker, video black jack, video slots, video lottery, etc., in whole or part.

The CPU 126 is also connected to an input/output (I/O) bus 122, which facilitates communication between the wagering game machine's components. The I/O bus 122 is connected to a payout mechanism 108, primary display 110, secondary display 112, value input device 114, player input device 116, information reader 118, NVRAM (Non-Volatile Random Access Memory) 150 and storage unit 130. The player input device 116 can include the value input device 114 to the extent the player input device 116 is used to place wagers. The I/O bus 122 is also connected to an external system interface 124, which is connected to external systems 104 (e.g., wagering game networks).

NVRAM 150 may be any type of NVRAM that maintains data across reboots or power on/off cycles of the wagering game machine.

Storage unit 130 may be any type of persistent storage unit that maintains data across reboots or power on/off cycles of the wagering game machine such that the data is persistent across reboots or power on/off cycles. Examples of such storage units include hard disks, CD-ROM drives, DVD-ROM drives, flash memory, compact flash memory etc.

In one embodiment, the wagering game machine 106 can include additional peripheral devices and/or more than one of each component shown in FIG. 1. For example, in one embodiment, the wagering game machine 106 can include multiple external system interfaces 124, multiple storage units 130 and/or multiple CPUs 126. In one embodiment, any of the components can be integrated or subdivided. Additionally, in one embodiment, the components of the wagering game machine 106 can be interconnected according to any suitable interconnection architecture (e.g., directly connected, hypercube, etc.).

In one embodiment, any of the components of the wagering game machine 106 can include hardware, firmware, and/or software for performing the operations described herein. Machine-readable media includes any mechanism that provides (e.g., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
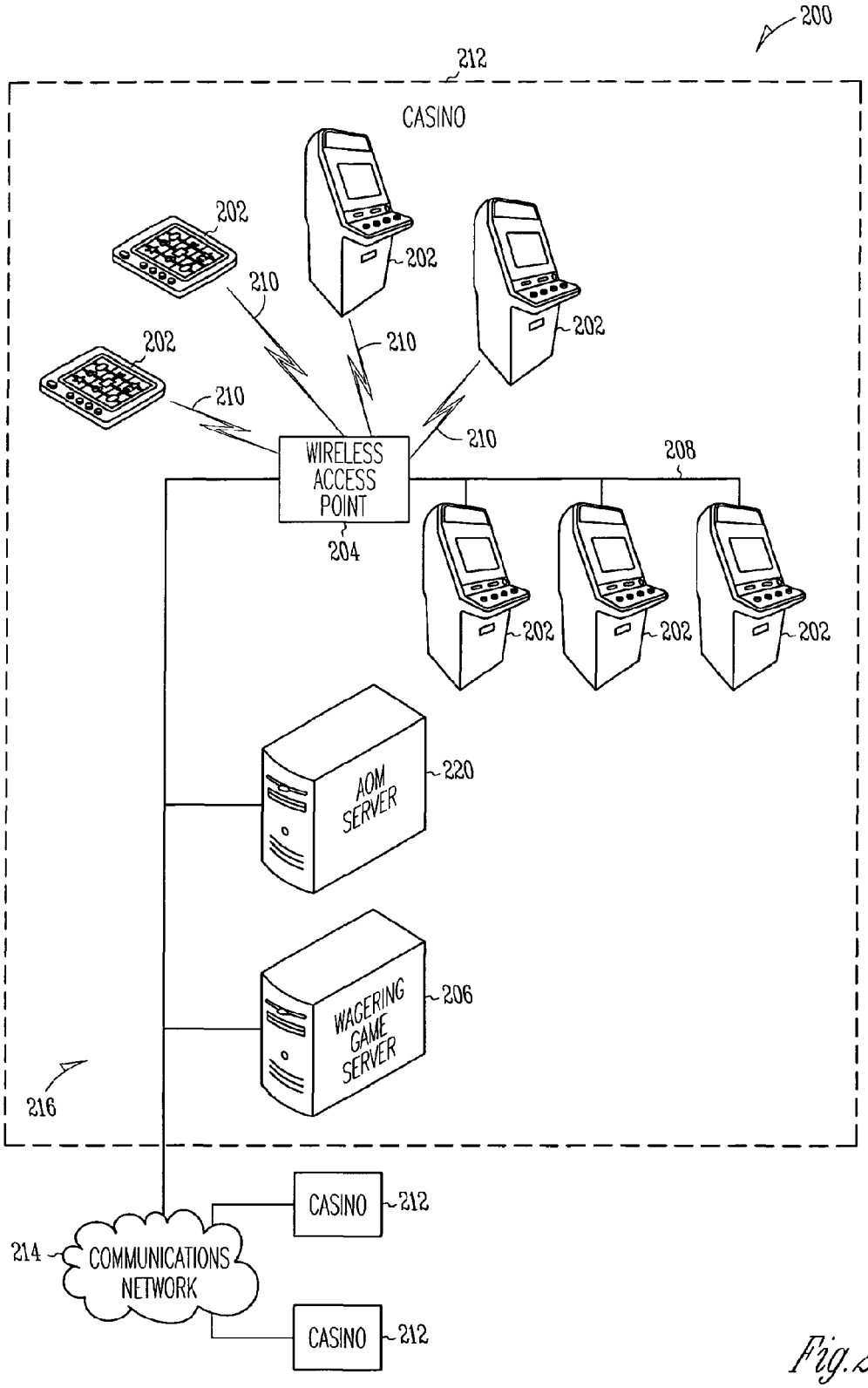
FIG. 2 is a block diagram illustrating a wagering game network, according to example embodiments of the invention.

While FIG. 1 describes example embodiments of a wagering game machine architecture, FIG. 2 shows how a plurality of wagering game machines can be connected in a wagering game network.

Example Wagering Game Network

FIG. 2 is a block diagram illustrating a wagering game network 200, according to example embodiments of the invention. As shown in FIG. 2, the wagering game network 200 may include a plurality of casinos 212 connected to a communications network 214.

Each of the plurality of casinos 212 may include a local area network 216, which may include a wireless access point 204, wagering game machines 202, a wagering game server 206 that can serve wagering games over the local area network 216. Further, wagering game network 216 may be coupled to a an AOM (Administration, Operation, and Maintenance) server 220. As such, the local area network 216 includes wireless communication links 210 and wired communication links 208. The wired and wireless communication links can employ any suitable connection technology, such as Bluetooth, 802.11, Ethernet, public switched telephone networks, SONET, etc. In one embodiment, the wagering game server 206 can serve wagering games and/or distribute content to devices located in other casinos 212 or at other locations on the communications network 214.

The wagering game machines 202, wagering game server 206 and AOM server 220 can include hardware and machine-readable media including instructions for performing the operations described herein.

The wagering game machines 202 described herein can take any suitable form, such as floor standing models, handheld mobile units, bartop models, workstation-type console models, etc. Further, the wagering game machines 202 can be primarily dedicated for use in conducting wagering games, or can include non-dedicated devices, such as mobile phones, personal digital assistants, personal computers, etc. In one embodiment, the wagering game network 200 can include other network devices, such as accounting servers, wide area progressive servers, player tracking servers, and/or other devices suitable for use in connection with embodiments of the invention.

AOM server 220 may provide for the administration, operation and maintenance of various machines on network 216, including wagering game machines 202 and wagering game servers 206.

In various embodiments, wagering game machines 202 and wagering game servers 206 work together such that a wagering game machine 202 may be operated as a thin, thick, or intermediate client. For example, one or more elements of game play may be controlled by the wagering game machine 202 (client) or the wagering game server 206 (server). Game play elements may include executable game code, lookup tables, configuration files, game outcome, audio or visual representations of the game, game assets or the like. In a thin-client example, the wagering game server 206 may perform functions such as determining game outcome or managing assets, while the wagering game machine 202 may be used merely to present the graphical representation of such outcome or asset modification to the user (e.g., player). In a thick-client example, game outcome may be determined locally (e.g., at the wagering game machine 202) and then communicated to the wagering game server 206 for recording or managing a player's account.

Similarly, functionality not directly related to game play may be controlled by the wagering game machine 202 (client), the wagering game server 206 or AOM server 220 in embodiments. For example, power conservation controls that manage a display screen's light intensity may be managed centrally (e.g., by the AOM server 220) or locally (e.g., by the wagering game machine 202). Other functionality not directly related to game play may include presentation of advertising, software or firmware updates, system quality or security checks, etc.

It should be noted that while wagering game server 206 and AOM server 220 have been shown as two separate servers, the functionality provided by the servers 206 and 220 may be provide by a single server, or may be distributed across more than two servers.

Example Wireless Environment

In some embodiments, the wireless access point 204 can be part of a communication station, such as wireless local area network (WLAN) communication station including a Wireless Fidelity (WiFi) communication station, or a WLAN access point (AP). In these embodiments, the wagering game machines 202 can be part of a mobile station, such as WLAN mobile station or a WiFi mobile station.

In some other embodiments, the wireless access point 204 can be part of a broadband wireless access (BWA) network communication station, such as a Worldwide Interoperability for Microwave Access (WiMax) communication station, as the wireless access point 204 can be part of almost any wireless communication device. In these embodiments, the wagering game machines 202 can be part of a BWA network communication station, such as a WiMax communication station.

In some embodiments, any of the wagering game machines 202 can part of a portable wireless communication device, such as a personal digital assistant (PDA), a laptop or portable computer with wireless communication capability, a web tablet, a wireless telephone, a wireless headset, a pager, an instant messaging device, a digital camera, a television, a medical device (e.g., a heart rate monitor, a blood pressure monitor, etc.), or other device that can receive and/or transmit information wirelessly.

In some embodiments, the wireless access point 204 and the wagering game machines 202 can communicate RF signals in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for wireless local area networks, but they can also be suitable to transmit and/or receive communications in accordance with other techniques and standards. In some BWA network embodiments, the wireless access point 204 and the wagering game machines 202 can communicate RF signals in accordance with the IEEE 802.16-2004 and the IEEE 802.16(e) standards for wireless metropolitan area networks (WMANs) including variations and evolutions thereof. However, they can also be suitable to transmit and/or receive communications in accordance with other techniques and standards. For more information with respect to the IEEE 802.11 and IEEE 802.16 standards, please refer to "IEEE Standards for Information Technology—Telecommunications and Information Exchange between Systems"—Local Area Networks—Specific Requirements—Part 11 "Wireless LAN Medium Access Control (MAC) and Physical Layer (PHY), ISO/IEC 8802-11: 1999", and Metropolitan Area Networks—Specific Requirements—Part 16: "Air Interface for Fixed Broadband Wireless Access Systems," Can 2005 and related amendments/versions.

In other embodiments, the wireless access point 204 and the wagering game machines 202 can communicate in accordance with a short-range wireless standard, such as the Bluetooth™ short-range digital communication protocol. Bluetooth™ wireless technology is a de facto standard, as well as a specification for small-form factor, low-cost, short-range radio links between mobile PCs, mobile phones and other portable devices. (Bluetooth is a trademark owned by Bluetooth SIG, Inc.) In other embodiments, the wireless access point 204 and the wagering game machines 202 can communicate in accordance with an ultra-wideband (UWB) communication technique where a carrier frequency is not used. In other embodiments, the wireless access point 204 and the wagering game machines 202 can communicate in accordance with an analog communication technique. In other embodiments, the wireless access point 204 and the wagering game machines 202 can communicate in accordance with an optical communication technique, such as the Infrared Data Association (IrDA) standard. In some embodiments, the wireless access point 204 and the wagering game machines 202 can communicate in accordance with the Home-RF standard which can be in accordance with a Home-RF Working Group (HRFWG) standard.

Figure 3:
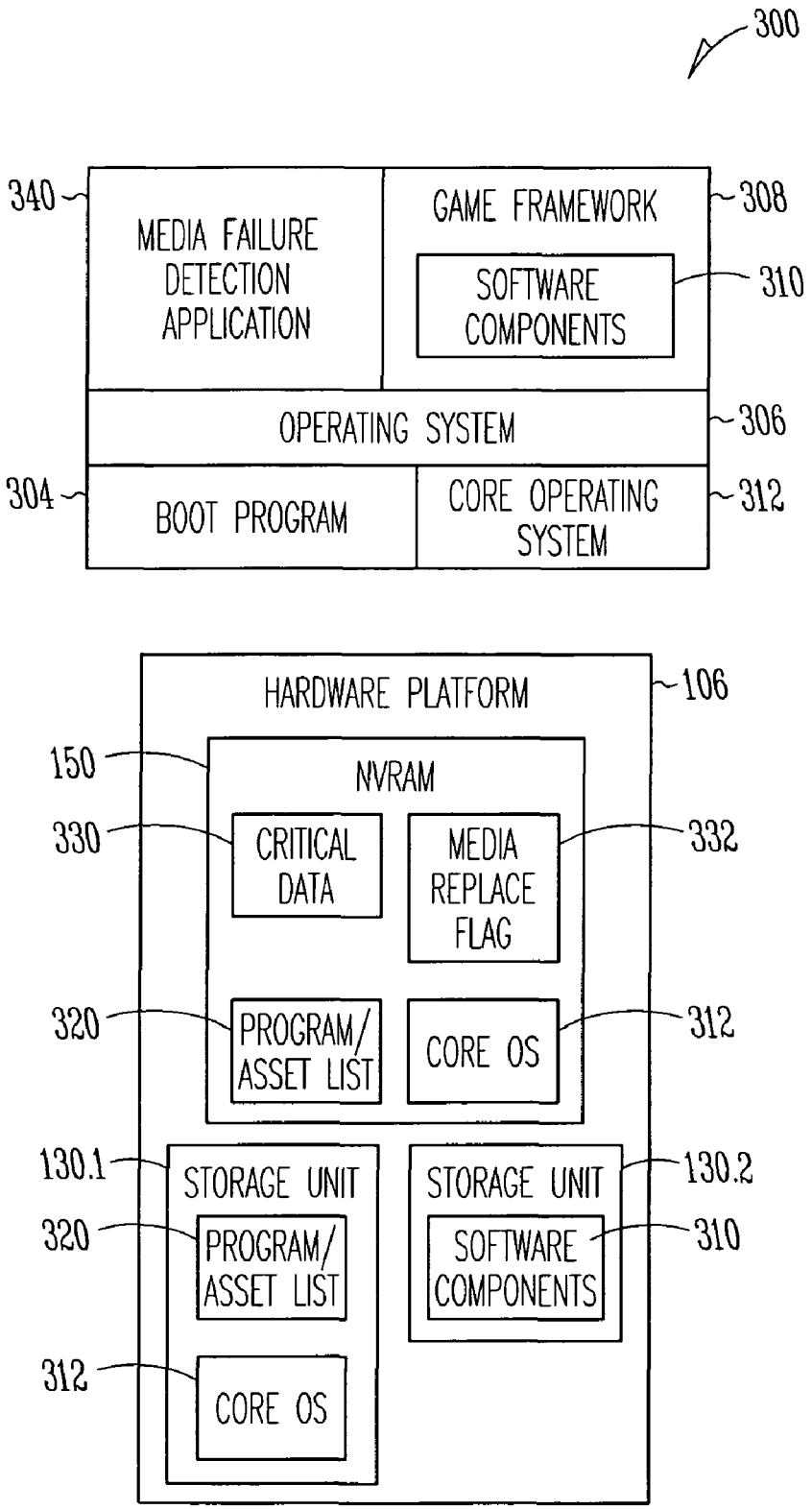
FIG. 3 is a block diagram of a software and hardware architecture for a wagering game machine, according to example embodiments of the inventive subject matter.

While FIGS. 1 and 2 describe example embodiments of a wagering game machine architecture and wagering game machines in a wagering game network, FIG. 3 shows a software architecture 300 and the relationship of the software architecture to elements of a hardware architecture for a wagering game machine.

Referring now to FIG. 3, there is illustrated a block diagram of a software architecture for a wagering game machine 300, according to example embodiments of the inventive subject matter. As shown in FIG. 3, the wagering game architecture includes a hardware platform 106, a boot program 304, an operating system 306, and a game framework 308 that includes one or more wagering game software components 310. In some embodiments, the architecture 300 may include a core operating system 312. The boot program 304 may include a basic input/output system (BIOS) or other initialization program that works in conjunction with the operating system 306 and/or core operating system 312 to provide a software interface to the hardware platform 106.

The game framework 308 may include standardized game software components either independent or in combination with specialized or customized game software components that are designed for a particular wagering game. In one example embodiment, the wagering game software components 310 may include software operative in connection with the hardware platform 106 and operating system 306 to present wagering games, such as video poker, video black jack, video slots, video lottery, etc., in whole or part. According to another example embodiment, the software components 310 may include software operative to accept a wager from a player. According to another example embodiment, one or more of the software components 310 may be provided as part of the operating system 306 or other software used in the wagering game system 300 (e.g., libraries, daemons, common services, etc.).

In some embodiments, software components 310 may be stored on a storage unit 130 prior to loading the components into main memory. For example, software components 310 may be stored on a hard drive on a wagering game machine, or other type of storage unit. Hard drives and other storage units 130 typically have a limited life, which may vary depending on the amount of use the storage unit is subjected to. As a result, it typically becomes necessary to replace a storage unit such as a hard drive that has failed with a suitable replacement storage unit.

According to one example embodiment, the architecture 300 may include a media failure detection application 340 to detect the failure of a persistent storage unit 130 on a wagering game machine and to rebuild software onto a replacement persistent storage unit.

Some embodiments include a core operating system 312 that operates as an operating system with reduced functionality when compared with operating system 306 and which may be used to save and restore content on a wagering game machine as further discussed below with reference to FIG. 4. Core OS 312 may be stored on a persistent storage unit 130, or it may be stored in NVRAM 150.

In some embodiments, NVRAM 150 includes a media replacement flag 332 that may be used as further discussed below when a replacement storage unit has been placed in a wagering game machine. In addition to the media replacement flag, NVRAM 150 may store critical data 330 used during the operation of the wagering game machine. Critical data is generally data that is maintained across reboots or power cycles for the gaming machine. Critical data may also include data that must be reported to one or more of the various regulatory agencies that control gaming in a jurisdiction. Examples of critical data may include, but are not limited to, one or more of the following:

- Number of winning outcomes
- Payout for the machine
- Wagering details (e.g. number of lines wagered, number coins wagered etc.)
- Coin-in amounts and denominations
- Current wager amount It is desirable to maintain critical data in NVRAM 150 to aid in auditing or recovering the state of a wagering game in the event of a hardware or software failure.

In some embodiments, an asset list 320 may be maintained in NVRAM 150 and/or on AOM server 220. Asset list 320 is a list of assets that are currently resident on a wagering game machine. In some embodiments, the asset list 320 may include, but is not limited to, a list of wagering game components such as application software, video files, audio files, image files, pay tables, denomination tables, bonus games, game libraries, operating system components, or any other file that may be loaded onto a persistent storage unit. The asset list may identify an asset by file name or product identifier. In some embodiments, the asset list includes a version identifier for the component.

In the example shown, the hardware platform includes two storage units 130.1 and 130.2. It should be noted that there may be more or fewer than two storage units 130, and that the storage units may be of different types. For example, storage unit 130.1 may be a compact flash storage unit while storage unit 130.2 may be a fixed or removable hard drive.

Example Methods and Operations

Figure 4:
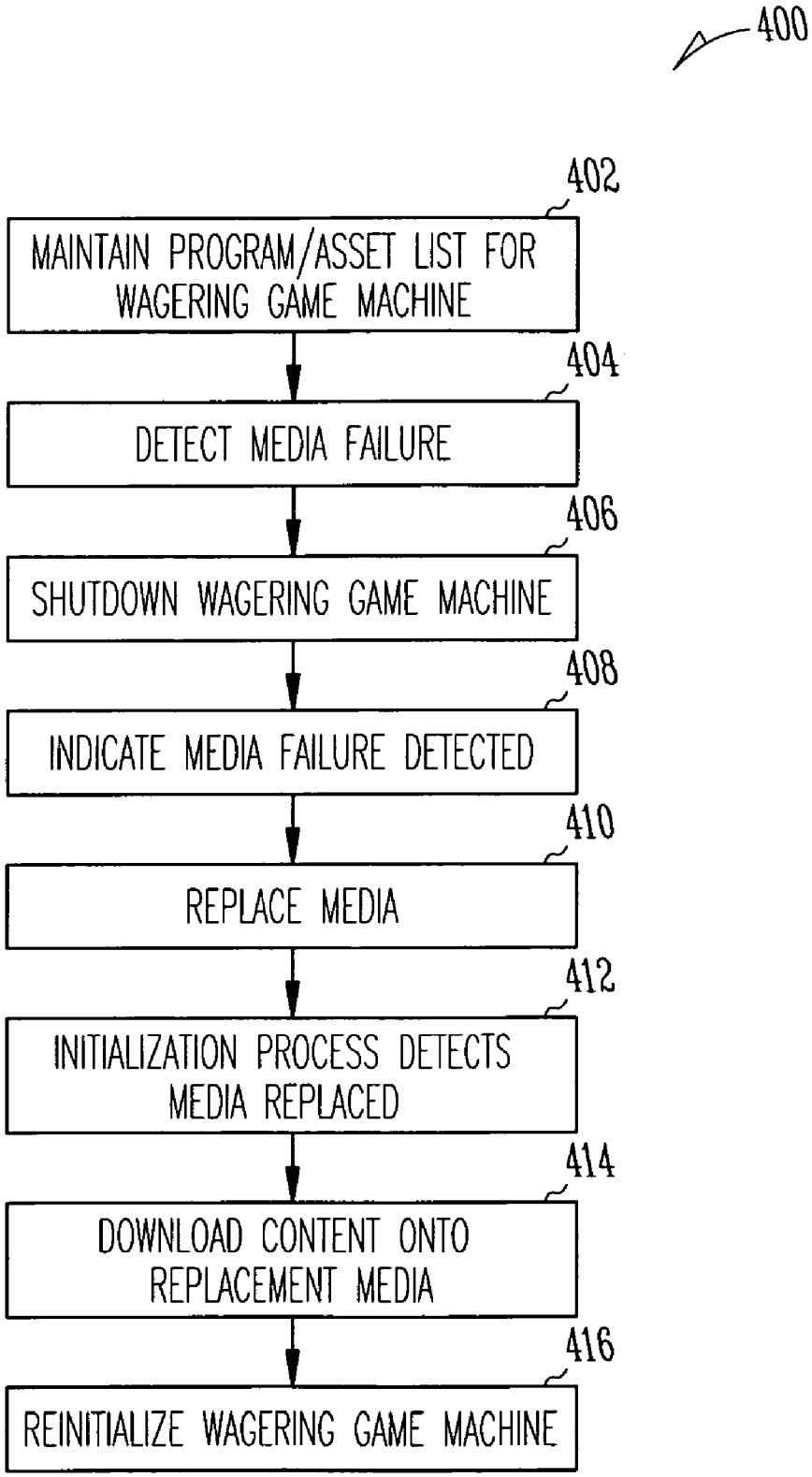
FIG. 4 is a flowchart illustrating a method for loading content on a replacement storage unit according to embodiments of the inventive subject matter.

FIG. 4 is a flowchart illustrating methods for loading content on a replacement storage unit according to embodiments of the inventive subject matter. In some embodiments, the method begins at block 402 by creating and maintaining an asset list 320 of programs and other software assets and components 310 that may be stored on a persistent storage unit 130 of a wagering game machine. The list may be stored in any of a number of places, including on the wagering game machine itself, for example, in NVRAM 150 or on a compact flash memory. Alternatively, the asset list may be stored on an AOM server or other server in a wagering game network. The embodiments are not limited to any particular location for storing an asset list. Further, as assets are updated, loaded or deleted from a persistent storage unit, the asset list may be updated to reflect the change such that the asset list reflects the software assets currently loaded on a storage unit.

At block 404, a storage unit failure is detected. Detection of a storage unit failure may include predicting or inferring that a storage unit failure is about to occur. One or more of a number of differing mechanisms may be used to detect a storage unit failure. For example, in some embodiments hard disk persistent storage units provide SMART (Self Monitoring Analysis and Reporting Technology) attributes that can be used to detect or predict failure of a hard disk. In this case, a replacement hard disk can be pre-ordered prior to the failure of the hard disk in the wagering game machine. In alternative embodiments, a read, write or seek error may be used to indicate a media failure. In further embodiments, the system may monitor a variety of parameters related to mechanical events on a hard disk, such as disk platter RPM, time to spin up, motor current, and sudden shock to the drive chassis. The embodiments are not limited to any particular method of detecting a storage unit failure.

Upon detection of a storage unit failure, or the detection of an imminent failure, at block 406 the wagering game machine may initiate a "graceful" shutdown. As part of the shutdown, the wagering game machine may halt play of any currently active wagering games and may offer a player a means to cashout or collect the balance remaining on the credit meter for the wagering game machine. Further, the wagering game machine may notify an AOM server 206 of the failure. Additionally, the wagering game machine may notify other systems (e.g. servers on the wagering game network, other wagering game machines participating in a community based or progressive game) of the failure in order to allow those systems to collect any data that may be desirable.

After reaching a state were the wagering game machine is ready to begin the recovery process, the wagering game machine may receive notification, perhaps from a casino technician, that it is being shut down to replace the persistent storage unit.

In some embodiments, at block 408 the wagering game machine may set media replace flag 332 in NVRAM 150 indicating the persistent storage unit is being replaced. Further, in some embodiments the wagering game machine may send a notification to an AOM server 206 that the replacement is about to begin. After these operations have completed, the wagering game machine may provide instructions to a casino technician to power down the wagering game machine.

At block 410, the failing persistent storage unit is replaced. For example, a technician may proceed to perform actions required to replace the persistent storage unit. Alternatively, a spare hard drive on a wagering game machine may used to replace a failing hard drive.

After the storage unit has been replaced, the wagering game machine is powered on. At block 412, the system detects that the persistent storage unit has been replaced. For example, during the boot process, core OS 312 recognizes that the flag in NVRAM 150 indicating the persistent storage unit is being replaced was set. In some embodiments, the core OS 312 may perform tests to verify that a new persistent storage unit is present and that it is functioning properly.

At block 414, content is automatically loaded onto the replacement storage unit. In some embodiments, the core OS 312 may notify the AOM server 220 to inform it that a new persistent storage unit is present and that the persistent storage unit is ready to receive wagering game related content to be downloaded from AOM server 220, wagering game server 206 or other server on the wagering game network. In some embodiments, the specific content to be downloaded may be determined based on the asset list of content created and maintained in NVRAM 150, or from the asset list 320 maintained by the wagering game machine or by AOM server 206. It is desirable that the versions of software downloaded be the same as the versions that previously existed on the wagering game machine before the persistent storage unit was replaced. Content may be pushed from the server to the wagering game machine, or it may be pulled from the server by the wagering game machine.

At block 416, after the content has been loaded on the replacement persistent storage unit, in some embodiments the wagering game machine is reset and boots as if coming up from a normal power cycle. In some embodiments, game state information is preserved in critical data 330 of NVRAM 150 and the replacement persistent storage unit content is the same as the old persistent storage unit, thereby allowing the wagering game machine to cleanly boot to the point that the wagering game machine was in prior to the failure of the persistent storage unit.

Example Wagering Game Machines

Example Wagering Game Machine

Figure 5:
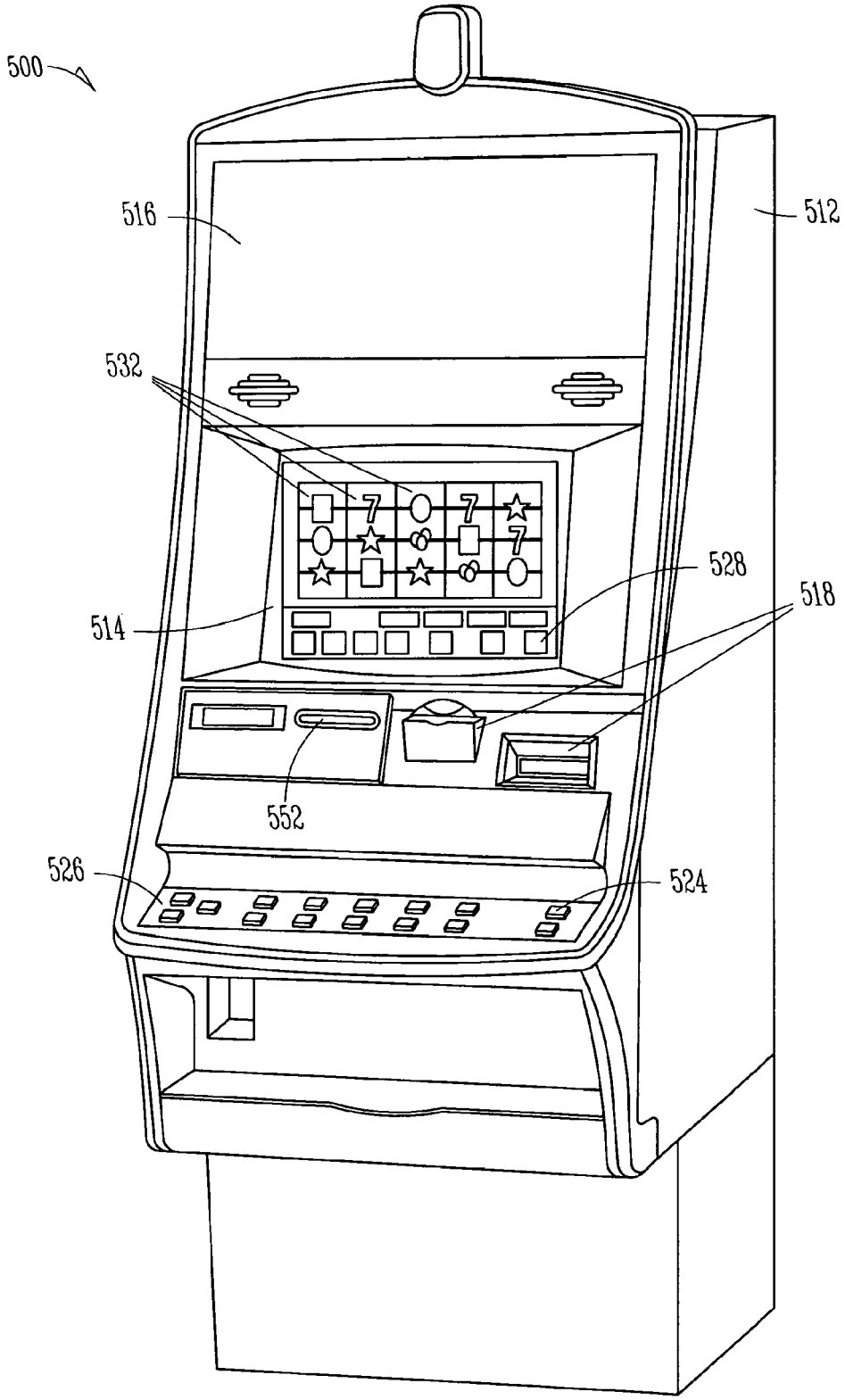
FIG. 5 is a perspective view of a wagering game machine, according to example embodiments of the invention.

FIG. 5 is a perspective view of a wagering game machine, according to example embodiments of the invention. Referring to FIG. 5, a wagering game machine 500 is used in gaming establishments, such as casinos. According to embodiments, the wagering game machine 500 can be any type of wagering game machine and can have varying structures and methods of operation. For example, the wagering game machine 500 can be an electromechanical wagering game machine configured to play mechanical slots, or it can be an electronic wagering game machine configured to play video casino games, such as blackjack, slots, keno, poker, blackjack, roulette, etc.

The wagering game machine 500 comprises a housing 512 and includes input devices, including value input devices 518 and a player input device 524. For output, the wagering game machine 500 includes a primary display 514 for displaying information about a basic wagering game. The primary display 514 can also display information about a bonus wagering game and a progressive wagering game. The wagering game machine 500 also includes a secondary display 516 for displaying wagering game events, wagering game outcomes, and/or signage information. While some components of the wagering game machine 500 are described herein, numerous other elements can exist and can be used in any number or combination to create varying forms of the wagering game machine 500.

The value input devices 518 can take any suitable form and can be located on the front of the housing 512. The value input devices 518 can receive currency and/or credits inserted by a player. The value input devices 518 can include coin acceptors for receiving coin currency and bill acceptors for receiving paper currency. Furthermore, the value input devices 518 can include ticket readers or barcode scanners for reading information stored on vouchers, cards, or other tangible portable storage devices. The vouchers or cards can authorize access to central accounts, which can transfer money to the wagering game machine 500.

The player input device 524 comprises a plurality of push buttons on a button panel 526 for operating the wagering game machine 500. In addition, or alternatively, the player input device 524 can comprise a touch screen 528 mounted over the primary display 514 and/or secondary display 516.

The various components of the wagering game machine 500 can be connected directly to, or contained within, the housing 512. Alternatively, some of the wagering game machine's components can be located outside of the housing 512, while being communicatively coupled with the wagering game machine 500 using any suitable wired or wireless communication technology.

The operation of the basic wagering game can be displayed to the player on the primary display 514. The primary display 514 can also display a bonus game associated with the basic wagering game. The primary display 514 can include a cathode ray tube (CRT), a high resolution liquid crystal display (LCD), a plasma display, light emitting diodes (LEDs), or any other type of display suitable for use in the wagering game machine 500. Alternatively, the primary display 514 can include a number of mechanical reels to display the outcome. In FIG. 5, the wagering game machine 500 is an "upright" version in which the primary display 514 is oriented vertically relative to the player. Alternatively, the wagering game machine can be a "slant-top" version in which the primary display 514 is slanted at about a thirty-degree angle toward the player of the wagering game machine 500. In yet another embodiment, the wagering game machine 500 can exhibit any suitable form factor, such as a free standing model, bartop model, mobile handheld model, or workstation console model.

A player begins playing a basic wagering game by making a wager via the value input device 518. The player can initiate play by using the player input device's buttons or touch screen 528. The basic game can include arranging a plurality of symbols along a payline 532, which indicates one or more outcomes of the basic game. Such outcomes can be randomly selected in response to player input. At least one of the outcomes, which can include any variation or combination of symbols, can trigger a bonus game.

In some embodiments, the wagering game machine 500 can also include an information reader 552, which can include a card reader, ticket reader, bar code scanner, RFID transceiver, or computer readable storage medium interface. In some embodiments, the information reader 552 can be used to award complimentary services, restore game assets, track player habits, etc.

Example Portable Wagering Game Machine

Figure 6:
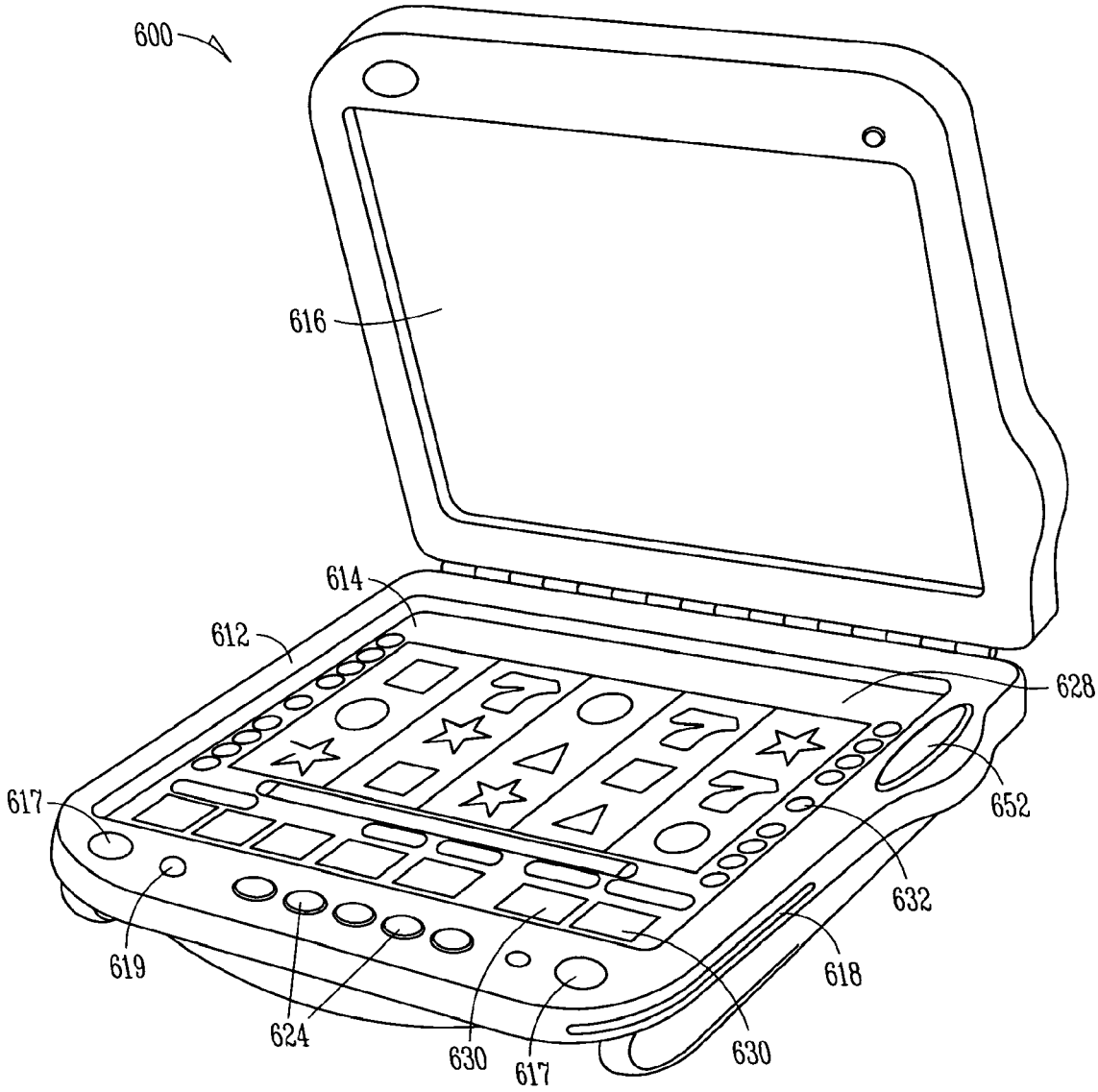
FIG. 6 shows an example embodiment of a portable wagering game machine according to example embodiments of the invention.

FIG. 6 shows an example embodiment of a portable wagering game machine 600. Like free standing wagering game machines, in a handheld or mobile form, the wagering game machine 600 can include any suitable electronic device configured to play a video casino games such as blackjack, slots, keno, poker, blackjack, and roulette. The wagering game machine 600 comprises a housing 612 and includes input devices, including a value input device 618 and a player input device 624. For output, the wagering game machine 600 includes a primary display 614, a secondary display 616, one or more speakers 617, one or more player-accessible ports 619 (e.g., an audio output jack for headphones, a video headset jack, etc.), and other conventional I/O devices and ports, which may or may not be player-accessible. In the embodiment depicted in FIG. 6, the wagering game machine 600 comprises a secondary display 616 that is rotatable relative to the primary display 614. The optional secondary display 616 can be fixed, movable, and/or detachable/attachable relative to the primary display 614. Either the primary display 614 and/or secondary display 616 can be configured to display any aspect of a non-wagering game, wagering game, secondary game, bonus game, progressive wagering game, group game, shared-experience game or event, game event, game outcome, scrolling information, text messaging, emails, alerts or announcements, broadcast information, subscription information, and wagering game machine status.

The player-accessible value input device 618 can comprise, for example, a slot located on the front, side, or top of the housing 612 configured to receive credit from a stored-value card (e.g., casino card, smart card, debit card, credit card, etc.) inserted by a player. The player-accessible value input device 618 can also comprise a sensor (e.g., an RF sensor) configured to sense a signal (e.g., an RF signal) output by a transmitter (e.g., an RF transmitter) carried by a player. The player-accessible value input device 618 can also or alternatively include a ticket reader, or barcode scanner, for reading information stored on a credit ticket, a card, or other tangible portable credit or funds storage device. The credit ticket or card can also authorize access to a central account, which can transfer money to the wagering game machine 600.

Still other player-accessible value input devices 618 can require the use of touch keys 630 on the touch-screen display (e.g., primary display 614 and/or secondary display 616) or player input devices 624. Upon entry of player identification information and, preferably, secondary authorization information (e.g., a password, PIN number, stored value card number, predefined key sequences, etc.), the player can be permitted to access a player's account. As one potential optional security feature, the wagering game machine 600 can be configured to permit a player to only access an account the player has specifically set up for the wagering game machine 600. Other conventional security features can also be utilized to, for example, prevent unauthorized access to a player's account, to minimize an impact of any unauthorized access to a player's account, or to prevent unauthorized access to any personal information or funds temporarily stored on the wagering game machine 600.

The player-accessible value input device 618 can itself comprise or utilize a biometric player information reader which permits the player to access available funds on a player's account, either alone or in combination with another of the aforementioned player-accessible value input devices 618. In an embodiment wherein the player-accessible value input device 618 comprises a biometric player information reader, transactions such as an input of value to the wagering game machine 600, a transfer of value from one player account or source to an account associated with the wagering game machine 600, or the execution of another transaction, for example, could all be authorized by a biometric reading, which could comprise a plurality of biometric readings, from the biometric device.

Alternatively, to enhance security, a transaction can be optionally enabled only by a two-step process in which a secondary source confirms the identity indicated by a primary source. For example, a player-accessible value input device 618 comprising a biometric player information reader can require a confirmatory entry from another biometric player information reader 652, or from another source, such as a credit card, debit card, player ID card, fob key, PIN number, password, hotel room key, etc. Thus, a transaction can be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 618 can be provided remotely from the wagering game machine 600.

The player input device 624 comprises a plurality of push buttons on a button panel for operating the wagering game machine 600. In addition, or alternatively, the player input device 624 can comprise a touch screen mounted to a primary display 614 and/or secondary display 616. In one aspect, the touch screen is matched to a display screen having one or more selectable touch keys 630 selectable by a user's touching of the associated area of the screen using a finger or a tool, such as a stylus pointer. A player enables a desired function either by touching the touch screen at an appropriate touch key 630 or by pressing an appropriate push button on the button panel. The touch keys 630 can be used to implement the same functions as push buttons. Alternatively, the push buttons 632, can provide inputs for one aspect of the operating the game, while the touch keys 630 can allow for input needed for another aspect of the game. The various components of the wagering game machine 600 can be connected directly to, or contained within, the housing 612, as seen in FIG. 6, or can be located outside the housing 612 and connected to the housing 612 via a variety of wired (tethered) or wireless connection methods. Thus, the wagering game machine 600 can comprise a single unit or a plurality of interconnected (e.g., wireless connections) parts which can be arranged to suit a player's preferences.

The operation of the basic wagering game on the wagering game machine 600 is displayed to the player on the primary display 614. The primary display 614 can also display the bonus game associated with the basic wagering game. The primary display 614 preferably takes the form of a high resolution LCD, a plasma display, an LED, or any other type of display suitable for use in the wagering game machine 600. The size of the primary display 614 can vary from, for example, about a 2-3" display to a 15" or 17" display. In at least some embodiments, the primary display 614 is a 7"-10" display. In one embodiment, the size of the primary display can be increased. Optionally, coatings or removable films or sheets can be applied to the display to provide desired characteristics (e.g., anti-scratch, anti-glare, bacterially-resistant and anti-microbial films, etc.). In at least some embodiments, the primary display 614 and/or secondary display 616 can have a 16:9 aspect ratio or other aspect ratio (e.g., 4:3). The primary display 614 and/or secondary display 616 can also each have different resolutions, different color schemes, and different aspect ratios.

As with the free standing embodiments a wagering gaming machine, a player begins play of the basic wagering game on the wagering game machine 600 by making a wager (e.g., via the value input device 618 or an assignment of credits stored on the handheld gaming machine via the touch screen keys 630, player input device 624, or buttons 632) on the wagering game machine 600. In some embodiments, the basic game can comprise a plurality of symbols arranged in an array, and includes at least one payline 628 that indicates one or more outcomes of the basic game. Such outcomes can be randomly selected in response to the wagering input by the player. At least one of the plurality of randomly selected outcomes can be a start-bonus outcome, which can include any variations of symbols or symbol combinations triggering a bonus game.

In some embodiments, the player-accessible value input device 618 of the wagering game machine 600 can double as a player information reader 652 that allows for identification of a player by reading a card with information indicating the player's identity (e.g., reading a player's credit card, player ID card, smart card, etc.). The player information reader 652 can alternatively or also comprise a bar code scanner, RFID) transceiver or computer readable storage medium interface. In one embodiment, the player information reader 652 comprises a biometric sensing device.

GENERAL

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

What is claimed is:

1. A method for execution by one or more processors, the method comprising:

setting an indicator to indicate replacement of a first persistent storage unit of a wagering game machine with a second persistent storage unit;

determining by the one or more processors that the indicator has been set to indicate replacement of the first persistent storage unit with the second persistent storage unit;

reading a list of software assets to be loaded onto the second persistent storage unit in response to the indicator being set; and loading software assets, based on the list of software assets, onto the second persistent storage unit.

2. The method of claim 1, further comprising detecting a failure of the first persistent storage unit.

3. The method of claim 2, wherein detecting the failure of the first persistent storage unit comprises reading one or more SMART (Self Monitoring Analysis and Reporting Technology) attributes maintained for the first persistent storage unit.

4. The method of claim 1 , wherein setting the indicator includes at least one of setting an indicator in a persistent memory of the wagering game machine, and sending a message to a server communicably coupled to the wagering game machine.

5. The method of claim 4, wherein the persistent memory comprises NVRAM.

6. The method of claim 1, wherein reading the list of software assets includes reading a version identifier for at least one of the software assets, and further wherein loading the software assets includes loading a software asset having the version identifier read from the list of software assets.

7. The method of claim 1, wherein loading the software assets include loading the software assets from a server communicably coupled to the wagering game machine.

8. An apparatus comprising:

a processor operable to present a wagering game upon which monetary value may be wagered;

a first persistent storage unit coupled to the processor; and at least one persistent memory coupled to the processor and operable to store an indicator value;

wherein the processor sets the indicator value upon detection of the replacement of the first persistent storage unit with a second persistent storage unit, and causes wagering game content to be loaded onto the second persistent storage unit when the indicator value indicates that the second persistent storage unit has replaced the first persistent storage unit;

wherein the wagering gaming content includes software assets that are loaded, by the processor, based on a list of software assets.

9. The apparatus of claim 8, wherein the at least one persistent memory comprises a non-volatile random access memory (NVRAM), and wherein the first persistent storage unit comprises a hard drive.

10. The apparatus of claim 8, further comprising a server operable to provide the wagering game content to be loaded onto the first persistent storage unit.

11. The apparatus of claim 8, further comprising a media failure detection application operable to detect a failure of the first persistent storage unit.

12. A non-transitory machine-readable medium having machine executable instructions for causing one or more processors to perform a method, the method comprising:

setting the indicator to indicate replacement of a first persistent storage unit of a wagering game machine with a second persistent storage unit;

determining that the indicator has been set to indicate replacement of the first persistent storage unit with the second persistent storage unit;

reading a list of software assets to be loaded onto the second persistent storage unit in response to the indicator being set; and loading software assets, based on the list of software assets, onto the second persistent storage unit.

13. The non-transitory machine-readable medium of claim 12, wherein the method further includes detecting the failure of the first persistent storage unit.

14. The non-transitory machine-readable medium of claim 13 wherein detecting the failure of the first persistent storage unit includes reading one or more S,M,A.R.T. (Self Monitoring Analysis and Reporting Technology) attributes maintained for the first persistent storage unit.

15. The non-transitory machine-readable medium of claim 12, wherein setting the indicator includes at least one of setting an indicator in a persistent memory of the wagering game machine, and sending a message to a server communicably coupled to the wagering game machine.

16. The non-transitory machine-readable medium of claim 15, wherein the persistent memory comprises NVRAM.

17. The non-transitory machine-readable medium of claim 12, wherein reading the list of software assets includes reading a version identifier for at least one of the software assets and further wherein loading the software assets includes loading a software asset having the version identifier read from the list of software assets.

18. The non-transitory machine-readable medium of claim 12, wherein loading the software assets includes loading the software assets from a server communicably coupled to the wagering game machine.

* * * * *

UNITED STATES PATENT AND TRADEMARK OFFICE

CERTIFICATE OF CORRECTION

PATENT NO. : 8,357,047 B2
APPLICATION NO. : 12/446303
DATED : January 22, 2013
INVENTOR(S) : Ryan et al.

It is certified that error appears in the above-identified patent and that said Letters Patent is hereby corrected as shown below:

In the Specification

In column 12, line 7, delete "RFID)" and insert --RFID--, therefor

In the Claims

In column 12, line 56, in Claim 4, delete "1 ," and insert --1,--, therefor

In column 14, line 14, in Claim 14, delete "S,M,A.R.T." and insert --S.M.A.R.T.--, therefor Signed and Sealed this
Fourth Day of February, 2014

Michelle K. Lee

Michelle K. Lee
*Deputy Director of the United States Patent and Trademark Office*